US006397796B1

(12) United States Patent
Styron et al.

(10) Patent No.: US 6,397,796 B1
(45) Date of Patent: Jun. 4, 2002

(54) OILING SYSTEMS AND METHODS FOR CHANGING LENGTHS OF VARIABLE COMPRESSION RATIO CONNECTING RODS

(75) Inventors: Joshua Putman Styron, Canton; Yash Andrew Imai, Troy; George Byron Schwartz; Kevin Michael Morrison, both of Ann Arbor, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/799,305

(22) Filed: Mar. 5, 2001

(51) Int. Cl.[7] ..... F02D 17/00

(52) U.S. Cl. ..... 123/78 AA; 123/78 BA; 123/78 E

(58) Field of Search ..... 123/78 AA, 78 BA, 123/78 E

(56) References Cited

U.S. PATENT DOCUMENTS 2,420,117 A * 5/1947 Weatherup
2,769,433 A * 11/1956 Humphreys
4,016,841 A * 4/1977 Karaba et al.
4,187,808 A * 2/1980 Audoux
4,516,537 A * 5/1985 Nakahara et al.
4,864,977 A * 9/1989 Hasegawa
5,803,028 A * 9/1998 Rose

OTHER PUBLICATIONS

U.S. application No. 09/690,946, Rao et al., filed Oct. 18, 2000.
U.S. application No. 09/690,951, Rao et al., filed Oct. 18, 2000.
U.S. application No. 09/691,667, Rao et al., filed Oct. 18, 2000.

* cited by examiner

*Primary Examiner*—Paul J. Hirsch
(74) *Attorney, Agent, or Firm*—Carlos L. Hanze

(57) ABSTRACT

An engine 20 has an oiling system including a pump (46) that delivers oil under nominal engine lubrication pressure to lubricate moving surfaces of the engine mechanism (42). The system also has first and second control passages (30, 32) to effect engine compression ratio change by operating connecting rod length change mechanisms (26A, 26B, 26C). Selectively operated hydraulic control devices cause pressure in the first passage to be greater than pressure in the second passage to effect an increase in engine compression ratio and pressure in the second passage to be greater than pressure in the first passage to effect a decrease in engine compression ratio. Multiple embodiments of the invention are disclosed.

18 Claims, 4 Drawing Sheets

OILING SYSTEMS AND METHODS FOR CHANGING LENGTHS OF VARIABLE COMPRESSION RATIO CONNECTING RODS

REFERENCE TO RELATED APPLICATIONS AND INCORPORATION BY REFERNCE

This application is related to the following commonly owned patent applications each of which is expressly incorporated in its entirety herein by reference: Ser. No. 09/691,667 , HYDRAULIC CIRCUIT FOR UNLOCKING VARIABLE COMPRESSION RATIO CONNECTING ROD LOCKING MECHANISMS; Ser. No. 09/690,951, HYDRAULIC CIRCUIT HAVING ACCUMULATOR FOR UNLOCKING VARIABLE COMPRESSION RATIO CONNECTING ROD LOCKING MECHANISMS; and Ser. No. 09/690,946, PULSE-OPERATED VARIABLE COMPRESSION RATIO CONNECTING ROD LOCKING MECHANISM.

BACKGROUND OF THE INVENTION

1. Field of the Invention

This invention relates generally to reciprocating piston type internal combustion (I.C.) engines for motor vehicles. More specifically it relates to I.C. engines having variable compression ratio connecting rods, especially to systems, mechanisms, and strategies that use hydraulic fluid for accomplishing connecting rod length change while an engine is running.

2. Background Information

The compression ratio built into the design of an internal combustion engine that has a non-variable compression ratio must be selected to avoid objectionable engine knock that would otherwise occur during certain conditions of engine operation if the compression ratio were higher. However, those conditions that give rise to engine knocking in a motor vehicle typically prevail only for limited times as the vehicle is being driven. At other times, such as when it is lightly loaded, the engine could operate with better efficiency, and still without knocking, if the compression ratio could be made higher.

Certain of those commonly owned pending patent applications incorporated herein by reference disclose engine connecting rods whose lengths can be changed automatically to change engine compression ratio. When the connecting rods have longer effective lengths, the engine has a higher compression ratio. When the connecting rods have shorter effective lengths, the engine has a lower compression ratio.

Included with the disclosures of those patent applications are hydraulic systems for effecting connecting rod length changes. Those systems use engine motor oil as hydraulic fluid. Change in overall effective length may be accomplished in either the connecting rod, or the piston, or in both, but it is preferred that effective length be changed at the large end of the connecting rod so that the incorporation of variable compression ratio by connecting rod length change does not adversely contribute to the reciprocating mass of an engine.

A connecting rod disclosed in the referenced applications comprises an assembly that contains a first part, a second part, and a third part assembled together to form the large end of the connecting rod assembly and provide a variable length for the connecting rod assembly. The first part is a semi-circular cap. One of the second and third parts is fastened tight to the first part. Guides disposed at opposite sides of the large end operatively relate the other of the second and third parts and the fastened parts to provide for relative sliding motion between the other of the second and third parts and the fastened parts over a limited adjustment range to change the length of the connecting rod assembly. Each connecting rod employs two such locking mechanisms, a first for locking the connecting rod in one length and a second for locking the connecting rod in another length.

When length is to be changed, a hydraulic system that uses engine motor oil as hydraulic fluid unlocks whichever one of the locking mechanism is locked. With both locking mechanisms unlocked, the centerline of the connecting rod large end is free to move relative to the centerline of the crank pin on which it is mounted via a bearing retainer, such as between a position of concentricity and a position of eccentricity. Inertial force acts to move the connecting rod such that the centerline of the large end is re-positioned relative to the centerline of the crank pin, thereby changing the effective length of the connecting rod from one length to the other. Upon completion of the length change, the other locking mechanism locks the connecting rod in the new length.

Requirements for any particular hydraulic system depend on the nature of the locking mechanisms. For certain types of locking mechanisms, a hydraulic system for effecting connecting rod length change from an initial length to a new length uses an increase in hydraulic pressure to cause the length change, but also requires maintenance of increased hydraulic pressure to maintain the new length. Discontinuance of the increased hydraulic pressure causes the connecting rod to revert to its original length.

For other types of locking mechanisms, another type of hydraulic system for effecting connecting rod length change from an initial length to a new length uses an increase in hydraulic pressure to cause the length change, but does not require maintenance of increased hydraulic pressure to maintain the new length. This is because of the particular types of locking mechanisms and because hydraulic pressure for unlocking each mechanism is delivered to each respective mechanism via its own devoted passageway when the respective mechanism is to be unlocked.

Each type of hydraulic system possesses its own particular advantages. The present invention concerns further improvements in such systems.

SUMMARY OF THE INVENTION

The present invention relates to novel systems, mechanisms, and strategies: for operating connecting rods, especially connecting rods of the types disclosed in the commonly owned referenced patent applications, to different lengths while an engine is running, thereby changing the engine compression ratio.

One generic aspect of the invention relates to an internal combustion engine comprising cylinders within which combustion takes place and an engine mechanism comprising a crankshaft that rotates about a crank axis and connecting rods via which the crankshaft is operatively coupled with pistons that reciprocate within the cylinders. An oiling system delivers oil under nominal engine lubrication pressure to lubricate moving surfaces of the engine mechanism and comprises first and second control passages to effect engine compression ratio change. Selectively operated hydraulic control devices cause pressure in the first passage to be greater than pressure in the second passage to effect an increase in engine compression ratio and cause pressure in the second passage to be greater than pressure in the first passage to effect a decrease in engine compression ratio.

Another generic aspect of the invention relates to a method of changing compression ratio of an internal combustion engine having cylinders within which combustion takes place, an engine mechanism comprising a crankshaft that rotates about a crank axis and connecting rods via which the crankshaft is operatively coupled with pistons that reciprocate within the cylinders, and an oiling system for delivering oil under nominal engine lubrication pressure to lubricate moving surfaces of the engine mechanism and comprising first and second control passages to effect engine compression ratio change. The method comprises selectively operating hydraulic control devices for causing pressure in the first passage to be greater than pressure in the second passage to effect an increase in engine compression ratio and for causing pressure in the second passage to be greater than pressure in the first passage to effect a decrease in engine compression ratio.

Further aspects will be seen in various features of presently preferred embodiments of the invention that will be described in detail.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT(S)

Figure 1:
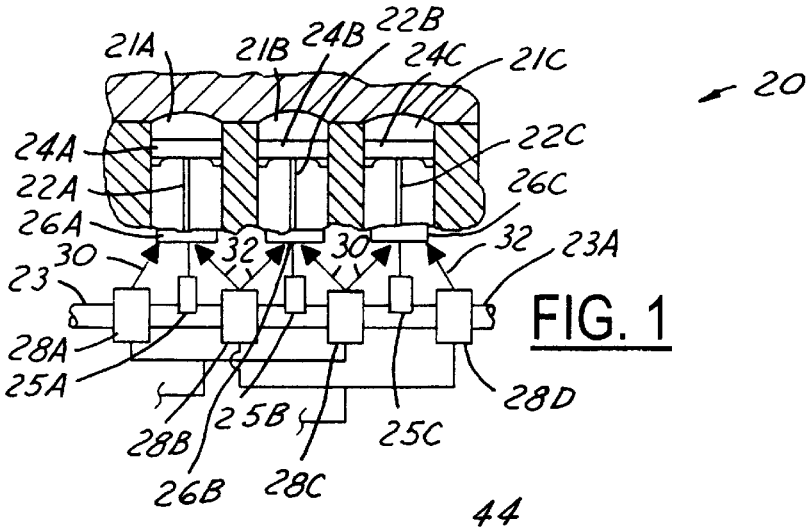
FIG. 1 is a schematic diagram of a portion of an internal combustion engine having variable length connecting rods and an oiling system for accomplishing connecting rod length change according to principles of the present invention.

FIG. 1 shows a schematic pictorial of a cylinder bank of an I.C. engine 20 comprising, by way of example, three cylinders 21A, 21B, 21C within which combustion takes place as the engine runs. Engine 20 comprises a mechanism that includes a crankshaft 23 that rotates about a crank axis 23A and three connecting rod assemblies 22A, 22B, 22C via which the crankshaft and reciprocating pistons 24A, 24B, 24C within the respective cylinders 21A, 21B, 21C are operatively coupled. Connecting rod assemblies 22A, 22B, 22C comprise respective length change mechanisms 26A, 26B, 26C for selectively setting the respective connecting rod assembly to a longer effective length and to a shorter effective length, and hence selectively setting engine 20 to a higher compression ratio and to a lower compression ratio.

Each connecting rod assembly comprises a large end for journaling on a respective crank pin 25A, 25B, 25C of crankshaft 23 and a small end for journaling on a central portion of a wrist pin for coupling the connecting rod assembly to a respective piston 24A, 24B, 24C. Each length change mechanism 26A, 26B, 26C is embodied in the respective large end. The reader should appreciate that the pistons are not shown in relative phasing in the cylinders because FIG. 1 is schematic in nature.

Engine also has an oiling system for delivering oil under nominal engine lubrication pressure through a system of passageways both to lubricate moving surfaces of the engine, including surfaces of the mechanism just described, and to effect engine compression ratio change via a first passage and a second passage.

Each length change mechanism comprises two locking mechanisms. One mechanism locks the connecting rod assembly in its shorter length setting, and the other, in its longer length setting. When a connecting rod length is to be changed, hydraulic fluid unlocks whichever one of the locking mechanisms of each length change mechanism is locked so that with the two locking mechanisms of each length change mechanism now unlocked, inertial force that acts on the connecting rod assembly as the engine runs changes the length. Upon completion of a length change, the other locking mechanism locks the connecting rod in the new length setting. More detail of the length change mechanisms and their locking mechanisms can be found in the referenced patent applications.

A hydraulic system for operating the locking mechanisms may take advantage of an existing engine oil pump and the system of oil passageways, including oil-passages in the engine crankshaft. Alternatively a system may comprise a modified oil pump and/or an additional pressure-boosting device.

FIG. 1 shows four main bearing journals 28A, 28B, 28C, and 28D for supplying oil to three connecting rod journals, i.e. crank pins 25A, 25B, 25C, of crankshaft 23 on which the three connecting rod assemblies 22A, 22B, 22C are respectively mounted. Oil can be supplied to each connecting rod assembly via a first passage 30 and a second passage 32. Passage 30 can supply oil to connecting rod assemblies 22A, 22B, 22C via main bearing journals 28A, 28C while passage 32 can supply oil to connecting rod assemblies 22A, 22B, 22C via main bearing journals 28B, 28D.

Figure 2:
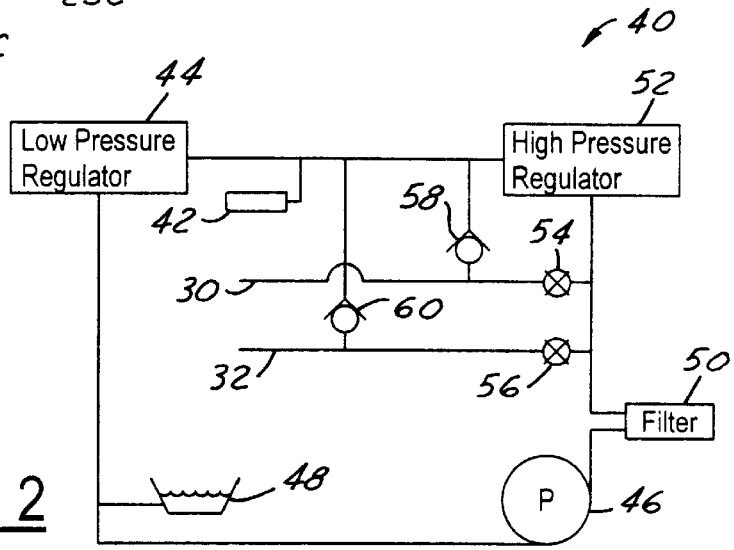
FIG. 2 is a schematic diagram of a first embodiment of oiling system for accomplishing connecting rod length change according to principles of the present invention.

FIG. 2 shows a first embodiment of hydraulic system 40 for effecting connecting rod length change integrated with an engine oiling system. The engine oiling system comprises a lubricating oil distribution system 42 comprising various galleries and passageways through which oil is delivered at nominal lubrication pressure for lubricating various moving surfaces within engine 20, including those surfaces mentioned earlier. In system 40, nominal lubrication pressure is established by a hydraulic device 44, an example of which is a low pressure regulator, or relief valve.

A pump 46, which may be driven by engine 20, draws oil from a sump 48, such as an engine oil pan, and supplies oil under pressure through a filter 50. The pressure of that supplied oil is established by a hydraulic device 52, an example of which is a high pressure regulator. Device 52 also provides a pressure drop for the supplied oil that allows device 44 to establish the nominal lubrication pressure. Excess oil returns from device 44 to sump 48. The reader can therefore appreciate that hydraulic pressure present between the outlet of pump 46 and device 52 is greater than the nominal lubrication pressure present in the portion of the passageway system between devices 44 and 52

System 40 comprises plural hydraulic control devices comprising a first solenoid valve 54, a second solenoid valve 56, a first check valve 58, and a second check valve 60. Solenoid valve 54 makes oil supplied by pump 46 at pressure greater than nominal engine lubrication pressure selectively available to first passage 30, and solenoid valve 56 does the same with respect to second passage 32. Both solenoid valves are normally closed.

When no connecting rod length change is being performed, neither valve 54, 56 is energized, and consequently, both valves are closed. Oil can nonetheless pass to both passages 30 and 32 via the respective check valves 58 and 60, but no significant difference exists between pressures in the respective passages 30, 32. Any oil delivered to a connecting rod while both valves 54, 56 are closed will be at pressure not exceeding nominal lubrication pressure, and hence may be used for lubrication.

When a change is to be made from an original connecting rod length to a new connecting rod length, one of valves 54, 56 is energized while the other of valves 54, 56 remains de-energized. If valve 54 is the one that opens to effect the length change, oil is delivered through it to passage 30 at pressure corresponding to that at the outlet of pump 46 while check valve 58 blocks flow that would otherwise pass through to elevate pressure of the oil being delivered through distribution system 42 to lubricate moving engine parts. In this way, the pressure in passage 30 is made positive relative both to pressure in passage 32 and to nominal engine lubrication pressure. The difference that is created between hydraulic pressure in passage 30 and hydraulic pressure in passage 32 unlocks the locked locking mechanism in the respective length change mechanism 26A, 26B, 26C of the respective connecting rod assembly. With both locking mechanisms of each length change mechanism unlocked, inertial force acting on each connecting rod assembly changes its length. As each length change is completed, the other locking mechanism in each length change mechanism locks to keep the length of the respective connecting rod assembly at the new length. The length change mechanisms are a type that does not require maintenance of the pressure differential between passages 30 and 32 to maintain the change (as disclosed in the referenced patent application Atty. Docket 200-1349), and therefore the one solenoid valve that had been energized to initiate the length change (i.e. valve 54) can now be de-energized.

To change the lengths back to the original lengths, solenoid valve 56 is energized while solenoid valve 54 remains de-energized. Oil is now delivered through valve 56 to passage 32 at pressure corresponding to that at the outlet of pump 46 while check valve 60 blocks flow that would otherwise pass through to elevate pressure of the oil being delivered through system 42 to lubricate moving engine parts. In this way, the pressure in passage 32 is made positive relative both to pressure in passage 30 and to nominal engine lubrication pressure. The difference that is created between hydraulic pressure in passage 32 and hydraulic pressure in passage 30 unlocks the locked locking mechanism in the respective length change mechanism 26A, 26B, 26C of the respective connecting rod assembly. With both locking mechanisms of each length change mechanism unlocked, inertial force acting on each connecting rod assembly changes its length back to the original length. As each length change is completed, the other locking mechanism in each length change mechanism locks to keep the length of the respective connecting rod assembly at the original length. Because the length change mechanisms are a type that does not require maintenance of the created pressure differential to maintain the change, the one solenoid valve that had been energized to initiate return to the original lengths (i.e. valve 56) can now be de-energized.

Figure 3:
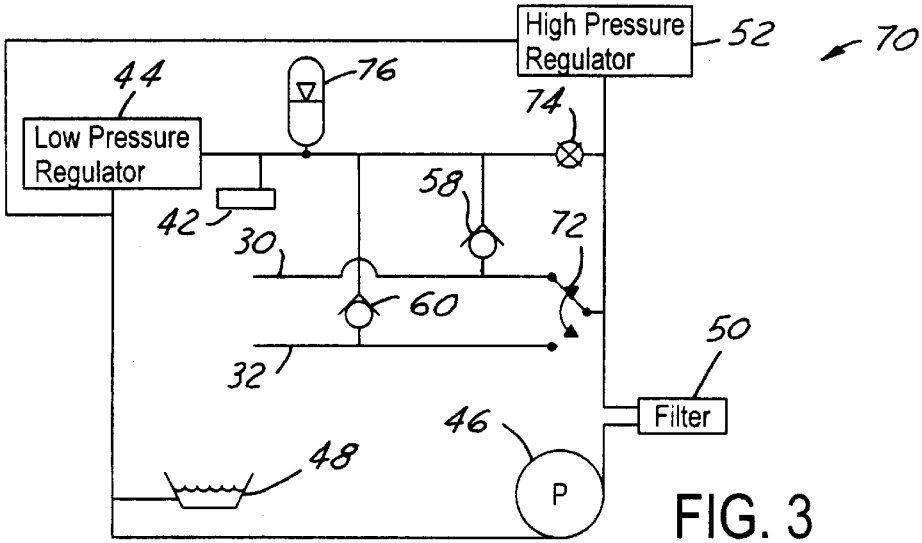
FIG. 3 is a schematic diagram of a second embodiment of oiling system for accomplishing connecting rod length change according to principles of the present invention.

FIG. 3 shows a second embodiment of hydraulic system 70 for effecting connecting rod length change in association with an engine oiling system. The oiling system comprises a lubricating oil distribution system 42 like that described in connection with FIG. 2. Like system 40, system 70 comprises a hydraulic device 44 (i.e. a low pressure regulator), a pump 46, a sump 48, a filter 50, a hydraulic device 52 (i.e. a high pressure regulator), and two check valves 58, 60. Additionally, system 70 comprises a selector valve 72, a normally open solenoid valve 74, and a low pressure hydraulic accumulator 76.

When connecting rod lengths are not being changed, valve 74 is not energized and therefore passes pumped oil flow. A portion of the flow is delivered to system 42 for lubrication, and a portion charges accumulator 76, at nominal lubrication pressure as established by low pressure regulator 44. Selector valve 72 communicates whichever one of passages 30, 32 it is selecting directly to the outlet of pump 46 via filter 50. Oil can pass to the other of passages 30, 32 via the respective check valve 58, 60. The small pressure difference between the two passages 30, 32 is insufficient to initiate a connecting rod length change. High pressure regulator 52 has no effect at this time.

When a length change is to be made, selector valve 72 operates to select the appropriate passage, and solenoid valve 74 is energized. With valve 74 now closed, pump pressure will build to whatever pressure is set by high pressure regulator 52, and that increased pressure will be applied to the selected passage 30, 32. The increased pressure is blocked by the corresponding check valve 58, 60 so that nominal lubrication pressure is maintained for the oil being delivered to system 42, now by the supply in accumulator 76. Consequently, a hydraulic pressure differential is created between passages 30 and 32 and that differential is effective to unlock whichever one of the locking mechanisms of each connecting rod is locked. Length change occurs in the manner for the earlier example. After completion of the length change, valve 74 is de-energized, and consequently re-opens. Pump outlet pressure returns to nominal lubrication pressure, accumulator 76 is replenished with oil, and the pressure differential between passages 30 and 32 diminishes to whatever existed before the length change.

To restore original length, selector valve 72 is operated to select the other passage 30, 32, and valve 74 is again energized. Pressure differential created between the two passages 30, 32 unlocks the locked mechanism of each rod, the original lengths are restored, and valve 74 is de-energized. During the length change accumulator 76 supplies nominal lubrication pressure oil to system 42, and regulator 52 establishes the increased pump pressure.

Figure 4:
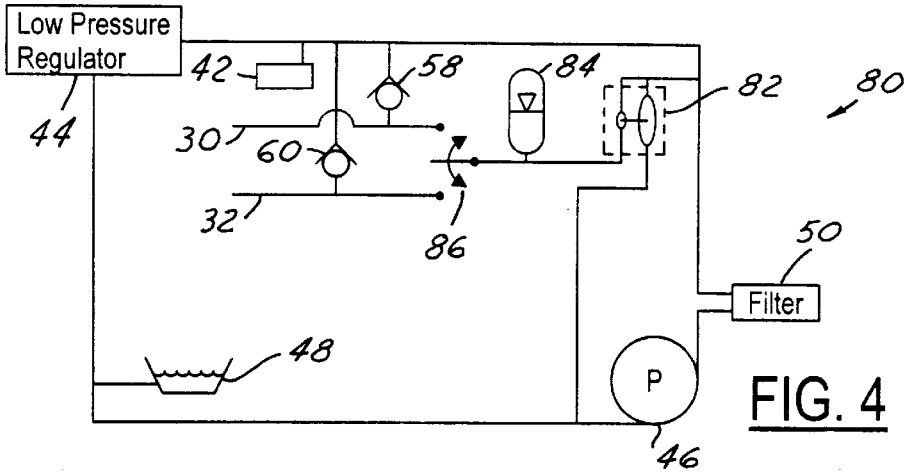
FIG. 4 is a schematic diagram of a third embodiment of oiling system for accomplishing connecting rod length change according to principles of the present invention.

FIG. 4 shows a third embodiment of hydraulic system 80 for effecting connecting rod length change in association with an engine oiling system. The oiling system comprises a lubricating oil distribution system 42 as previously described. System 80 comprises a hydraulic device 44, an example of which is a low pressure regulator, a pump 46, a sump 48, a filter 50, and check valves 58, 60. System 80 also comprises a hydraulic amplifier 82, a high pressure hydraulic accumulator 84, and a three-position selector valve 86.

Pump 46 supplies oil at nominal lubrication pressure established by low pressure regulator 44 for use by system 42, with some of the supplied oil passing through check valves 58 and 60 to passages 30 and 32 when no length change is being performed. Some of the pumped oil is used to operate hydraulic amplifier 82. When no length change is being performed, valve 86 is in a state that blocks both passages 30 and 32 from accumulator 84, enabling amplifier 82 to charge accumulator 84 with oil at a pressure that is greater than the pump outlet pressure.

When a length change is to be made, selector valve 86 operates to select the appropriate passage 30, 32 for connection to the outlet of accumulator 84. The high pressure oil is supplied to the selected passage 30, 32, while the respective check valve 58, 60 blocks flow of that oil to system 42. The high pressure oil has sufficient pressure to create a differential pressure between passages 30 and 32 that is effective to unlock whichever one of the locking mechanisms of each connecting rod is locked. Length change and re-locking in the new length position occur as described for previous embodiments. After completion of the length change, valve 86 operates to block both passages 30 and 32 from accumulator 84, thereby discontinuing the pressure differential between passages 30 and 32.

To return the connecting rods to their original lengths, the opposite passage 30, 32 is selected by valve 86 to create an appropriate pressure differential to unlock the locked locking mechanism of each connecting rod. After original lengths have been restored and the length change mechanisms re-locked, valve 86 is operated to select neither passage 30, 32, thereby discontinuing the pressure differential between passages 30 and 32.

Figure 5:
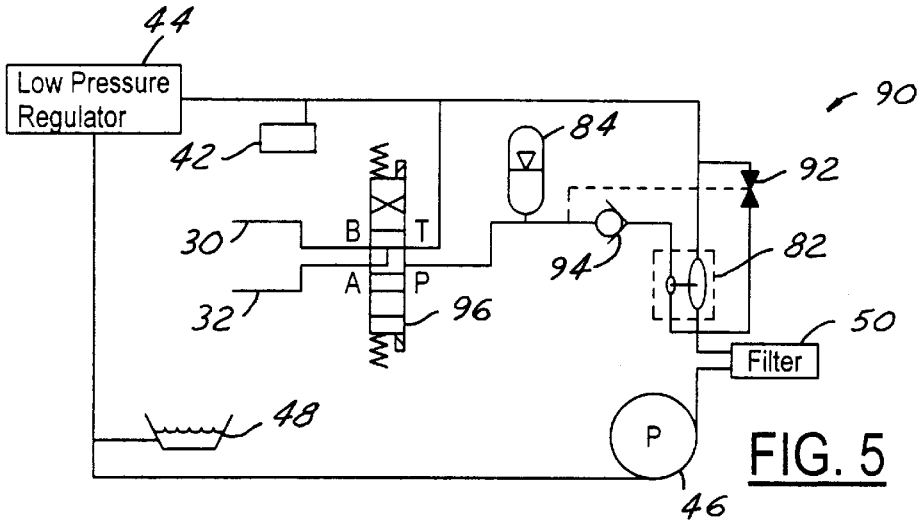
FIG. 5 is a schematic diagram of a fourth embodiment of oiling system for accomplishing connecting rod length change according to principles of the present invention.

FIG. 5 shows a fourth embodiment of hydraulic system 90 for effecting connecting rod length change in association with an engine oiling system. The oiling system comprises a lubricating oil distribution system 42 like that already described. System 90 comprises a hydraulic device 44 (i.e. a low pressure regulator), a pump 46, a sump 48, a filter 50, a hydraulic amplifier 82, and a high pressure hydraulic accumulator 84. Additionally system 90 comprises a pressure-activated by-pass valve 92, a check valve 94, and a four-way, three-position, center-biased, solenoid-operated, directional control valve 96.

In FIG. 5 hydraulic amplifier 82 is in series with pump 46, rather than in parallel as it was in FIG. 4. Amplifier 82 keeps accumulator 84 charged through check valve 94. Whenever the accumulator needs charging, by-pass valve 92 closes, and once accumulator 84 has been charged, by-pass valve 92 opens. With valve 92 open, pump 46 can deliver oil at nominal lubrication pressure to distribution system 42. When valve 96 is not actuated, it assumes its center-biased position to allow oil at nominal lubrication pressure to flow to passages 30 and 32.

When a connecting rod length change is initiated, the appropriate one of the two solenoids of valve 96 is energized to connect the appropriate passage 30, 32 to accumulator 84. The other passage 30, 32 continues to be communicated to oil at a nominal lubrication pressure. The pressure differential created between passage 30 and passage 32 unlocks the locked locking mechanism of each connecting rod, inertia forces change the rod lengths, and once the length changes have been completed, the length change mechanisms lock the connecting rods in their new positions. Valve 96 is then de-energized and returns to the center position to place both passages 30, 32 at the same nominal pressure.

When the connecting rods are to be restored to their original lengths, the other solenoid of valve 96 is energized. An opposite pressure differential is created between passage 30 and passage 32. Original length is restored in the same way described for previous embodiments. When all rods have been re-locked in their original lengths, valve 96 is de-energized to return it to its center position.

Figure 6:
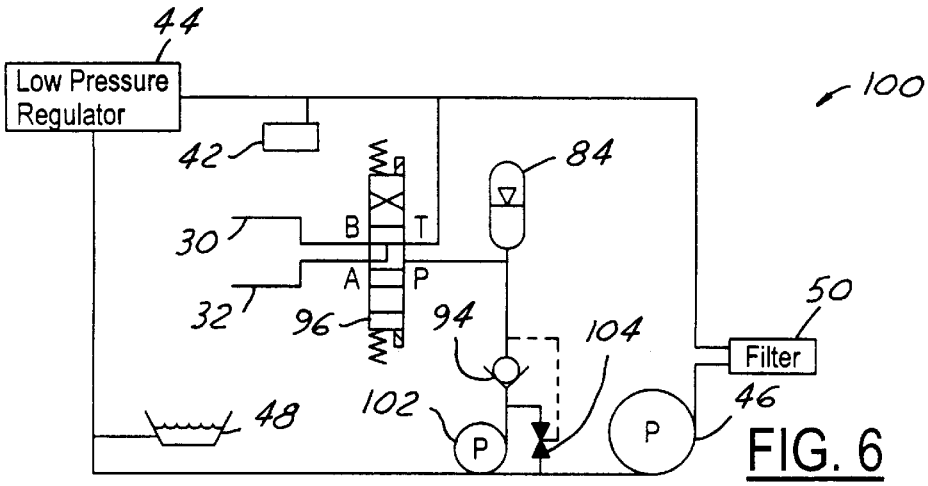
FIG. 6 is a schematic diagram of a fifth embodiment of oiling system for accomplishing connecting rod length change according to principles of the present invention.

FIG. 6 shows a fifth embodiment of hydraulic system 100 for effecting connecting rod length change in association with an engine oiling system. The oiling system comprises a lubricating oil distribution system 42 as described previously. System 100 comprises a hydraulic device 44 (i.e. a low pressure regulator), a pump 46, a sump 48, a filter 50, a check valve 94, and a four-way, three-position, center-biased, solenoid-operated, directional control valve 96. Additionally, system 100 comprises a secondary pump 102 and a pressure-activated by-pass valve 104. At all times, the existing oiling system supplies oil at nominal lubrication pressure to system 42 directly from pump 46 through filter 50.

For providing the increased pressure needed to effect connecting rod length change, pump 102 draws oil from sump 48 to charge accumulator 84 through check valve 94. accumulator charging occurs when valve 104 is closed. When he accumulator has been charged to an appropriate pressure, by-pass valve 104 opens to unload pump 102. If pump 102 is being mechanically driven, valve 104 may be electrically controlled by a pressure switch associated with the accumulator. Alternatively, if the pump is being mechanically driven through a clutch, accumulator pressure may be used to control clutch engagement and disengagement. If pump is being electrically driven, a pressure switch associated with the accumulator may cycle the pump on and off as appropriate to keep the accumulator charged.

Connecting rod length change from an original length to a new length and restoration of original length are accomplished by operating valve 96 as described in connection with FIG. 5.

Figure 7:
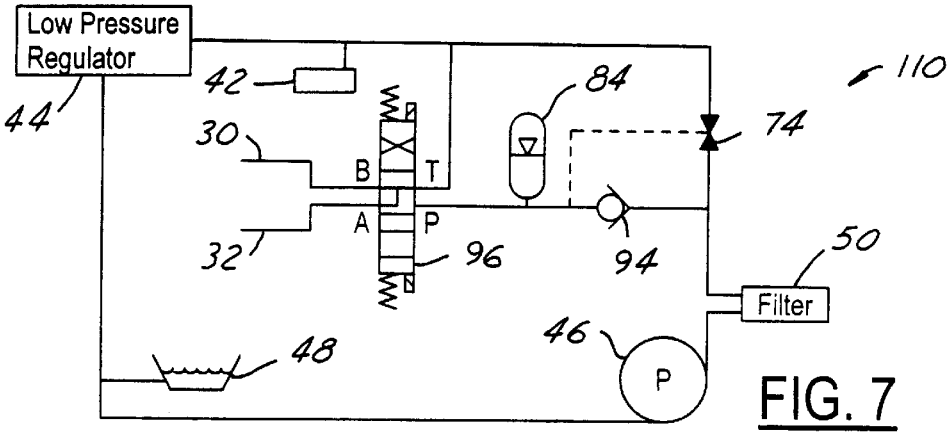
FIG. 7 is a schematic diagram of a sixth embodiment of oiling system for accomplishing connecting rod length change according to principles of the present invention.

FIG. 7 shows a sixth embodiment of hydraulic system 110 for effecting connecting rod length change in association with an engine oiling system. The oiling system comprises a lubricating oil distribution system 42 like that already described. System 110 comprises a hydraulic device 44 (i.e. a low pressure regulator), a pump 46, a sump 48, a filter 50, a solenoid valve 74, a high pressure hydraulic accumulator 84, a check valve 94, and a four-way, three-position, center-biased, solenoid-operated, directional control valve 96.

With valve 74 closed, pump 46 charges accumulator 84 through filter 50 and check valve 94. When the accumulator has been charged to an appropriate pressure, valve 74 opens. Check valve 94 maintains high pressure oil in accumulator 94 for use until needed. With valve 74 open pump 46 delivers oil to system 42 at nominal lubrication pressure as established by device 44, i.e. a low pressure regulator.

Connecting rod length change from an original length to a new length and restoration of original length are accomplished by operating valve 96 as described in connection with FIG. 5.

Figure 8:
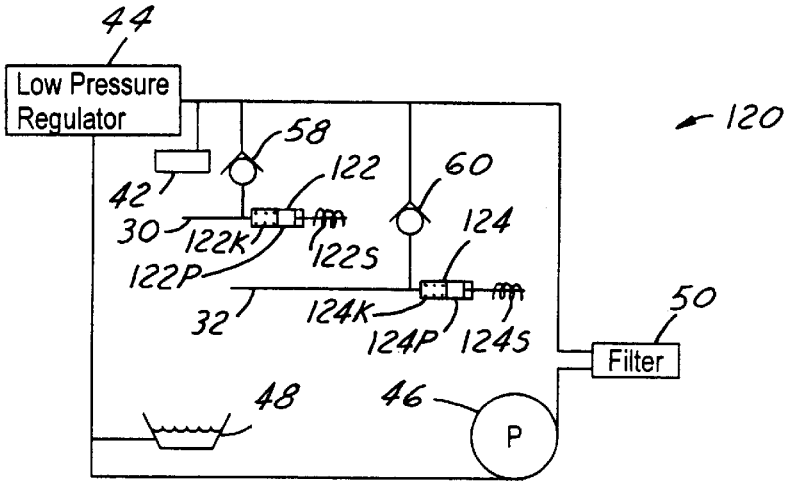
FIG. 8 is a schematic diagram of a seventh embodiment of oiling system for accomplishing connecting rod length change according to principles of the present invention.

FIG. 8 shows a seventh embodiment of hydraulic system 120 for effecting connecting rod length change in association with an engine oiling system. The oiling system comprises a lubricating oil distribution system 42 like that already described. System 120 comprises a hydraulic device 44 (i.e. a low pressure regulator), a pump 46, a sump 48, a filter 50, check valves 58 and 60, a first solenoid-driven piston pump 122, and a second solenoid-driven piston pump 124. Each pump comprises a respective piston 122P, 124P that is stroked within a respective cylinder. A respective solenoid 122S, 124S is energized to stroke the respective piston, and a respective return spring 122K, 124K serves to return the respective piston when the respective solenoid is de-energized after having stroked the respective piston.

Pump 46 supplies oil through filter 50 for lubrication at nominal lubrication pressure established by device 44. Some of the pumped oil is used to charge pumps 122 and 124 preparatory to stroking. When a solenoid is de-energized to allow the corresponding spring to return the corresponding piston using spring force, the piston will tend to draw a charge of oil into the respective pump. The respective check valve allows nominal lubrication pressure oil to be drawn during pump charging, while disallowing reverse flow when the pump is stroked to expel its charge of oil to the length change mechanisms.

For changing connecting rod length, the appropriate solenoid 122S, 124S is actuated to stroke the respective piston. The stroking piston expels oil from its charge into the corresponding passage 30, 32. The pressure rises sufficiently above that in the other passage for a sufficient time to unlock the locked mechanisms of the respective connecting rod length change mechanisms. Inertial forces change the connecting rod lengths and the length change mechanisms lock the rods in their new lengths. Once the piston has stroked, the pressure increase decays toward nominal lubrication pressure, and solenoid energization is discontinued. The respective spring 122K, 124K retracts the stroked piston to allow a fresh charge of oil to fill the respective pump. Restoration of connecting rod length is accomplished by stroking the other pump.

Figure 9:
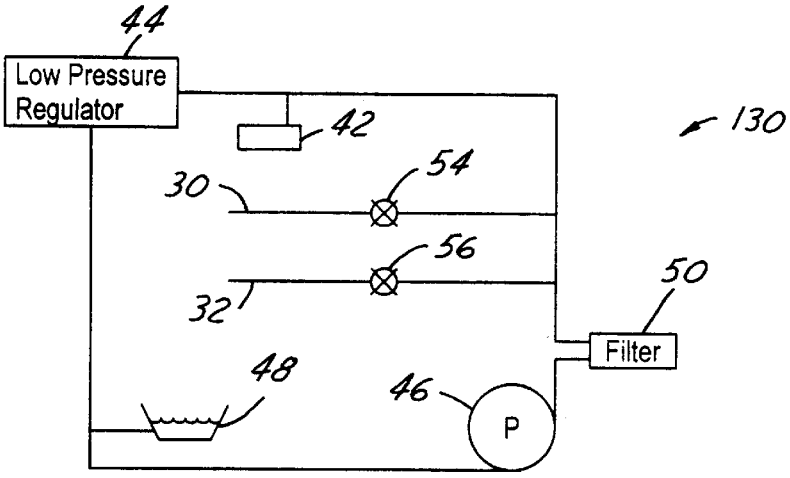
FIG. 9 is a schematic diagram of an eighth embodiment of oiling system for accomplishing connecting rod length change according to principles of the present invention.

FIG. 9 shows an eighth embodiment of hydraulic system 130 for effecting connecting rod length change in association with an engine oiling system. The oiling system comprises a distribution system 42 like that previously described. Like system 40, system 130 comprises a hydraulic device 44 (a low pressure regulator), a pump 46, a sump 48, a filter 50, and solenoid valves 54, 56. Unlike previous embodiments, system 130 creates pressure differential between passages 30, 32 by depriving one of oil. The appropriate passage is deprived of oil by energizing the respective valve 54, 56 to close that valve while the other valve 54, 56 remains de-energized and hence open. Hence, the pressure differential will correspond substantially to the setting of device 44, i.e. a low pressure regulator. Length change and re-locking of the length change mechanisms occurs as in the previous embodiments. To restore length, the opposite valve is energized, and the lengths are restored in the same manner as described for the previous embodiments.

Figure 10:
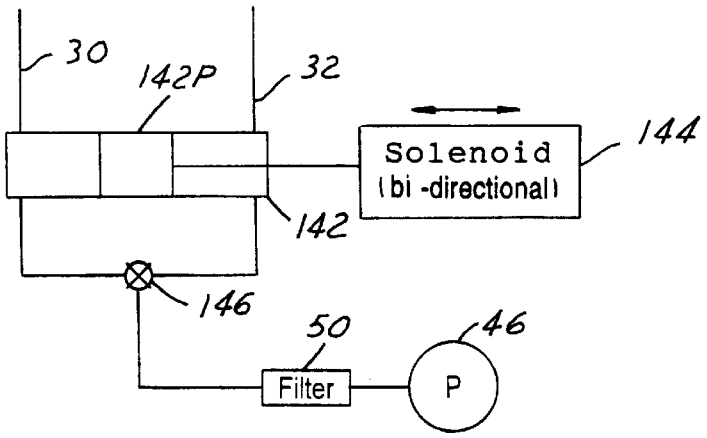
FIG. 10 is a schematic diagram of a ninth embodiment of oiling system for accomplishing connecting rod length change according to principles of the present invention.

FIG. 10 shows a ninth embodiment of hydraulic system 140 for effecting connecting rod length change in association with an engine oiling system. The system is rather similar to that of FIG. 8, and the same elements are identified by like reference numerals. Rather than having two separate pumps 122, 124, the pumping functions for accomplishing connecting rod length changes are embodied in a single pump 142 having a single piston 142P that is stroked in one direction to initiate a length change in one direction and in the opposite direction to: initiate a length change in the opposite direction. While the piston is stroking in one direction to expel a charge of oil from one end into one of the passages 30, 32, it is drawing existing oil from the other passage 30, 32 into its opposite end. In this way a greater pressure difference between passages 30 and 32 can be achieved than in prior embodiments where oil is being forced into one passage without existing oil being drawn from the other passage. The greater pressure difference arises because while oil is being forced under pressure out of one end of the pump into one of the two passages, the pressure in the other passage is being relieved because the existing oil is being drawn into the opposite end of the pump. The piston is operated by a bi-directional solenoid 144. Such a solenoid may have one coil for displacing the piston in one direction and another coil for displacing the piston in the opposite direction. The piston is spring-biased to the center position as shown, and it assumes that position when neither coil is being energized. Operation of an electric-controlled shut-off valve 146 is coordinated with operation of solenoid 144 to block backflow of the oil that is being expelled from one end of pump 142 into one of the passages 30, 32 and at the same time disallow fresh oil from pump 46 from entering the other end of pump 142 while oil is being drawn from the other passage 30, 32 by the piston motion.

Figure 11:
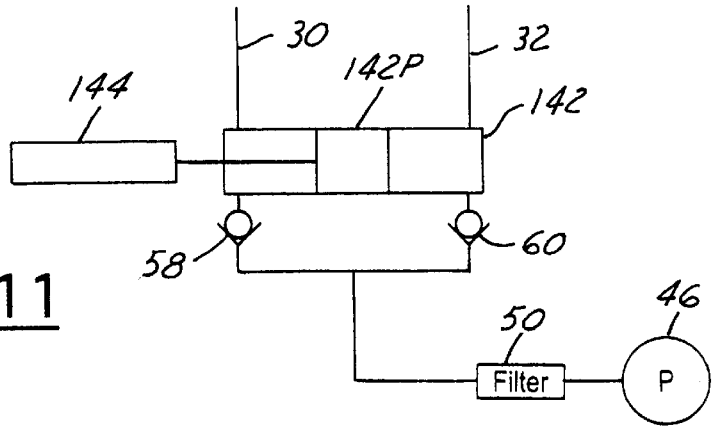
FIG. 11 is a schematic diagram of a tenth embodiment of oiling system for accomplishing connecting rod length change according to principles of the present invention.

FIG. 11 shows another embodiment that is exactly like that of FIG. 10 except that valve 146 is replaced by check valves 58 and 60 as shown.

Figure 12:
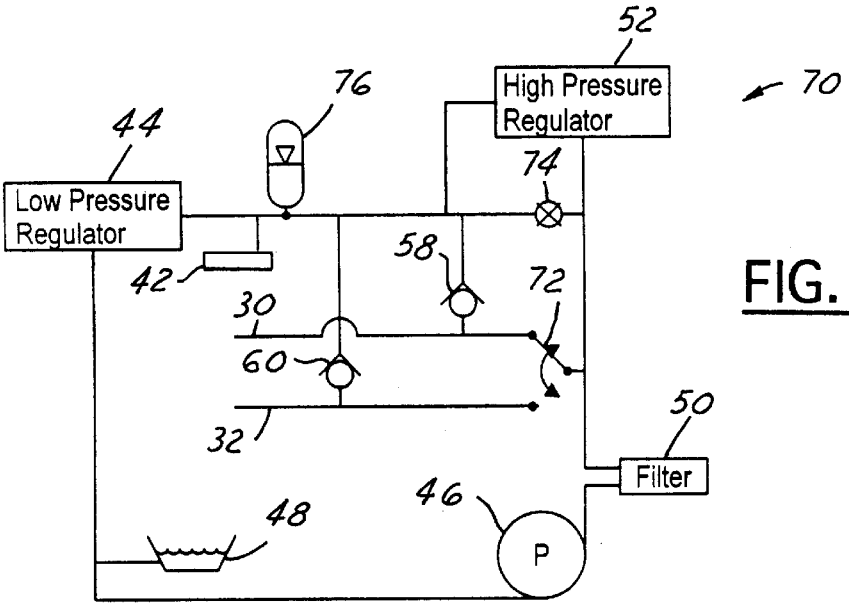
FIG. 12 is a schematic diagram of an eleventh embodiment of oiling system for accomplishing connecting rod length change according to principles of the present invention.

FIG. 12 shows another embodiment that is exactly like that of FIG. 3 except more efficient in that oil relieved by high pressure regulator 52 passes to lubrication system 42, rather than being dumped directly to sump 48.

Each of the various systems that have been described possesses its own particular advantages. Certain advantages are common to certain systems but not others. For example, although system 40 requires that the pump operate essentially continuously at high-pressure, it is considered relatively easy to adapt to any particular engine and relatively easy to control. On the other hand, system 70 requires an accumulator, but it provides operational efficiency because the pump doesn't have to continually pump oil at high pressure. The hardware requirements are obviously different for different systems, but certain items of hardware are common to various systems.

While a presently preferred embodiment has been illustrated and described, it is to be appreciated that the invention may be practiced in various forms within the scope of the following claims.

What is claimed is:

1. An internal combustion engine comprising:

cylinders within which combustion takes place;

an engine mechanism comprising a crankshaft that rotates about a crank axis and connecting rods via which the crankshaft is operatively coupled with pistons that reciprocate within the cylinders;

an oiling system for delivering oil under nominal engine lubrication pressure to lubricate moving surfaces of the engine mechanism and comprising first and second control passages to which oil is supplied to effect engine compression ratio change;

selectively operated hydraulic control devices for causing pressure in the first passage to be greater than pressure in the second passage to effect an increase in engine compression ratio and for causing pressure in the second passage to be greater than pressure in the first passage to effect a decrease in engine compression ratio.

2. An internal combustion engine as set forth in claim 1 in which the oiling system comprises a source for supplying oil at pressure greater than nominal engine lubrication pressure to effect engine compression ratio change, and the hydraulic control devices comprise a device for attenuating the pressure of oil supplied by the source pump to nominal engine lubrication pressure for lubricating the moving surfaces.

3. An internal combustion engine as set forth in claim 2 in which the source comprises a pump for supplying oil at pressure greater than nominal engine lubrication pressure to effect engine compression ratio change.

4. An internal combustion engine as set forth in claim 3 in which the hydraulic control devices comprise a device for making oil supplied by the pump at pressure greater than nominal engine lubrication pressure selectively available to the first passage, and a device for making oil supplied by the pump at pressure greater than nominal engine lubrication pressure selectively available to the second passage.

5. An internal combustion engine as set forth in claim 4 in which each respective device for making oil supplied by the pump at pressure greater than nominal engine lubrication pressure selectively available respectively to the first passage and respectively to the second passage comprises a respective solenoid valve.

6. An internal combustion engine as set forth in claim 5 in which the hydraulic control devices comprise a first check valve through which oil whose pressure is attenuated by the device for attenuating the pressure of oil supplied by the pump to nominal engine lubrication pressure can flow to the first passage, and a second check valve through which oil whose pressure is attenuated by the device for attenuating the pressure of oil supplied by the pump to nominal engine lubrication pressure can flow to the second passage.

7. An internal combustion engine as set forth in claim 1 in which the oiling system comprises a pump for supplying oil at nominal engine lubrication pressure for lubricating the moving surfaces and a hydraulic amplifier operated by oil from the pump for supplying oil at pressure greater than nominal engine lubrication pressure to effect engine compression ratio change.

8. An internal combustion engine as set forth in claim 7 including an accumulator for accumulating a supply of oil from the hydraulic amplifier at pressure greater than nominal engine lubrication pressure.

9. An internal combustion engine as set forth in claim 8 in which the hydraulic control devices comprise control valving through which the hydraulic amplifier can deliver oil from the accumulator selectively to the first passage and to the second passage.

10. An internal combustion engine as set forth in claim 9 in which the hydraulic control devices comprise a first check valve through which oil at nominal engine lubrication pressure from the pump can flow to the first passage, and a second check valve through which oil at nominal engine lubrication pressure from the pump can flow to the second passage.

11. An internal combustion engine as set forth in claim 1 in which the oiling system comprises a first pump for supplying oil at nominal engine lubrication pressure for lubricating the moving surfaces and a second pump for supplying oil at pressure greater than nominal engine lubrication pressure to effect engine compression ratio change, and the control devices comprise valving through which the oil at nominal lubrication pressure and at pressure greater than nominal lubrication pressure are selectively communicated to the first and second passages.

12. An internal combustion engine as set forth in claim 11 in which the oiling system includes an accumulator that is supplied by the second pump, and in which the valving comprises a three-way, solenoid-operated directional control valve for selectively communicating the accumulator and the first pump to the first and second passages.

13. An internal combustion engine as set forth in claim 12 in which the second pump is cycled on and off to maintain pressure greater than nominal lubrication pressure in the accumulator.

14. An internal combustion engine as set forth in claim 1 in which a respective normally open solenoid valve fluid-couples the respective control passage to nominal engine lubrication pressure oil; and wherein a first of the solenoid valves is operated closed while a second remains open to create pressure differential between the first passage and the second passage to effect an increase in engine compression ratio, and the second solenoid valve is operated closed while the first remains open to create pressure differential between the first passage and the second passage to effect a decrease in engine compression ratio.

15. An internal combustion engine as set forth in claim 1 in which selectively operated hydraulic control devices for causing pressure in the first passage to be greater than pressure in the second passage to effect an increase in engine compression ratio and for causing pressure in the second passage to be greater than pressure in the first passage to effect a decrease in engine compression ratio comprise a pump mechanism that draws oil from the second passage to relieve pressure in the second passage when an increase in engine compression ratio is being effected and that draws oil from the first passage to relieve pressure in the first passage when a decrease in engine compression ratio is being effected.

16. A method of changing compression ratio of an internal combustion engine having cylinders within which combustion takes place, an engine mechanism comprising a crankshaft that rotates about a crank axis and connecting rods via which the crankshaft is operatively coupled with pistons that reciprocate within the cylinders, and an oiling system for delivering oil under nominal engine lubrication pressure to lubricate moving surfaces of the engine mechanism and comprising first and second control passages to effect engine compression ratio change, the method comprising:

selectively operating hydraulic control devices for causing pressure in the first passage to be greater than pressure in the second passage to effect an increase in engine compression ratio and for causing pressure in the second passage to be greater than pressure in the first passage to effect a decrease in engine compression ratio.

17. A method as set forth in claim 16 in which the step of causing pressure in the first passage to be greater than pressure in the second passage to effect an increase in engine compression ratio comprises supplying oil at nominal lubrication pressure to the first passage while decreasing the oil pressure supplied to the second passage, and the step of causing pressure in the second passage to be greater than pressure in the first passage to effect a decrease in engine compression ratio comprises supplying oil at nominal lubrication pressure to the second passage while decreasing the oil pressure supplied to the first passage.

18. A method as set forth in claim 16 in which the step of causing pressure in the first passage to be greater than pressure in the second passage to effect an increase in engine compression ratio comprises supplying oil at pressure greater than nominal lubrication pressure to the first passage while supplying oil at nominal lubrication pressure to the second passage, and the step of causing pressure in the second passage to be greater than pressure in the first passage to effect a decrease in engine compression ratio comprises supplying oil at pressure greater than nominal lubrication pressure to the second passage while supplying oil at nominal lubrication pressure to the first passage.

* * * * *